US005625930A

United States Patent [19]

Takizawa et al.

[11] Patent Number: 5,625,930

[45] Date of Patent: May 6, 1997

[54] MOLDED SURFACE FASTENER

[75] Inventors: Toshiaki Takizawa; Ryuichi Murasaki, both of Toyama-ken, Japan

[73] Assignee: YKK Corporation, Tokyo, Japan

[21] Appl. No.: 519,400

[22] Filed: Aug. 25, 1995

[30] Foreign Application Priority Data

Aug. 26, 1994 [JP] Japan ..... 6-202260

[51] Int. Cl.[6] ..... A44B 18/00

[52] U.S. Cl. ..... 24/452; 24/442

[58] Field of Search ..... 24/306, 442–452, 24/575–577; 428/100

[56] References Cited

U.S. PATENT DOCUMENTS

| | | | |
|---|---|---|---|
| 3,555,630 | 1/1971 | Wylde | 24/447 |
| 4,541,154 | 9/1985 | Ito et al. | 24/446 X |
| 4,739,635 | 4/1988 | Conley et al. | 66/190 |
| 4,984,339 | 1/1991 | Provost et al. | 24/452 |
| 5,067,210 | 11/1991 | Kayaki | 24/452 |
| 5,131,119 | 7/1992 | Murasaki et al. | 24/452 |
| 5,339,499 | 8/1994 | Kennedy et al. | 24/452 |
| 5,361,462 | 11/1994 | Murasaki | 24/452 |
| 5,457,856 | 10/1995 | Murasaki | 24/452 |

FOREIGN PATENT DOCUMENTS

| | | | |
|---|---|---|---|
| 0464754A | 1/1992 | European Pat. Off. | 24/442 |
| WO92/15262 | 9/1992 | European Pat. Off. . | |
| 0698351A2 | 2/1996 | European Pat. Off. . | |
| 2047243 | 3/1971 | France | 24/447 |
| 2291114 | 1/1996 | United Kingdom . | |

*Primary Examiner*—Peter M. Cuomo
*Assistant Examiner*—Robert J. Sandy
*Attorney, Agent, or Firm*—Hill, Steadman & Simpson

[57] ABSTRACT

A molded surface fastener comprising a substrate sheet, and a multiplicity of engaging elements molded in rows on one surface of said substrate sheet. Each of the engaging elements has a pair of stems standing from the one surface of the substrate sheet, and a pair of hooks extending in opposite directions from distal ends of the stems and formed in a pair of parallel planes perpendicular to the general plane of the substrate sheet on opposite sides of the central line of the pair of stems. When companion loops are disengaged from the engaging element, the individual hooks are angularly moved about the central line of the pair of stems in a horizontal plane independently of each other and, at the same time, are expanded upwardly. As a result, the loops and the engaging element can be disengaged from one another smoothly without any damage.

9 Claims, 6 Drawing Sheets

MOLDED SURFACE FASTENER

BACKGROUND OF THE INVENTION

1. Field of the Invention

This invention relates to a molded synthetic resin surface fastener in which a substrate sheet and a multiplicity of engaging elements projecting from one surface of the substrate sheet are formed integrally with each other, and more particularly to a molded surface fastener which has adequate engaging strength and rate suitable for use in a joint of industrial materials, such as ceiling materials and wall materials, subject to peeling forces and which has adequate durability without giving damage to engaging elements of the companion surface fastener at the time of peeling.

2. Description of the Related Art

Molded surface fasteners of the described type have greater engaging strength compared to the ordinary knitted or woven surface fasteners and are therefore widely used in joining interior ornamental materials, such as wall materials and ceiling materials. Generally, the individual engaging element of the molded surface fastener has a stem standing from one surface of a substrate sheet, and a hook curving in one direction from the distal end of the stem and terminating in an end directed to the surface of the substrate sheet.

In the case that the individual engaging element of the molded surface fastener is a hooked member having the above-mentioned simple hook structure, in order to increase the degree of strength of engagement with a looped member, which is the companion engaging element, it has been customary to mold the engaging elements of rigid synthetic resin or to increase the size of the looped member. However, the rigid engaging element will give an undesirable touch and it tends to be out of engagement of the companion looped member. In the case of the large-sized looped member, it not only would become rigid but would be reduced in the number of engaging elements per unit area on the substrate sheet, thus making it difficult to secure a predetermined degree of engaging strength. If one of the hooked and looped members is increased in size, the other member of smaller size teams to be damaged when the looped member is disengaged from the hooked member.

Consequently, soft synthetic resin materials, such as polyester, polyamide and polyurethane, usually suitable for molded surface fasteners are used, and at the same time, various forms of engaging elements are put into practice in order to secure the relative strength of hooked and looped members and in order to increase the engaging strength. A typical form of engaging element, as disclosed in, for example, Japanese Patent Laid-Open Publications Nos. SHO 47-31740 and HEI 4-224703, has front and rear engaging portions symmetrically projecting from the distal end of a generally trapezoidal hook. An alternative form, as disclosed in, for example, Japanese Utility Model Laid-Open Publication No. HEI 4-128611, has front and rear hooks symmetrically branched from the distal end of a stem. According to these known forms, the number of engaging elements per unit area on the substrate sheet increases to increase the rate of engagement with companion engaging elements so that the engaging strength of the entire surface fastener is increased.

The foregoing surface fasteners for industrial materials are not subject to repeated engaging and disengaging as often as the ordinary surface fasteners for daily goods. However, if they are used in interior materials of cars, the interior material has to be peeled off the car body when the car body is inspected or repaired.

In the engaging element disclosed in each of the above-identified publications, a single looped member tends to come into engagement with the front and rear engaging portions at the same time, which is a so-called hanging engagement, so that the looped member can hardly be disengaged from the engaging portions. If the peeling of the surface fastener is forced, the looped member or engaging portion in hanging engagement would be broken and thereafter the engaging strength would be lowered.

Yet when the looped members come into engagement with at least one of the front and rear engaging portions with no banging engagement, the upward force acting on the engaging portions simply tends to act upwardly so that the engaging portion tends to be broken at its base, i.e. the joint of the engaging portion and the stem.

SUMMARY OF THE INVENTION

It is therefore an object of this invention to provide an engaging element, for a molded surface fastener, which has a rational form to secure a desired degree of engaging strength and in which the individual engaging portions act so as to allow a peeling force on the surface fastener to escape when the peeling force is too strong, so that the engaging element can be easily disengaged from the companion engaging element without any damage to the engaging elements, even when a looped member is in a hanging engagement with engaging portions, thus guaranteeing an excellently durable surface fastener.

According to the invention, there is provided a molded surface fastener comprising: a substrate sheet; and a multiplicity of engaging elements molded in rows on one surface of the substrate sheet, each of the engaging elements having a pair of stems standing from the one surface of the substrate sheet, and a pair of hooks extending in opposite directions from distal ends of the stems, said pair of hooks being formed in a pair of parallel planes perpendicular to the general plane of the substrate sheet on opposite sides of the central line of the pair of stems.

In this invention, in each engaging element, a part of the pair of hooks and also most part of the pair of stems are integral with each other. Or each engaging element is composed of first and second hooked members each having the stem and the hook, and the first and second hooked members are integrally joined together over at least part of confronting side surfaces of the stems.

Further, the hooks of the first and second hooked members may be identical in height with each other, or they may be different in height from each other.

If the thickness of the front and rear hooks is equal to that of the conventional hooked members, the total thickness of the stems of the engaging element of this invention is substantially double the thickness of the conventional hooked members. When a peeling force is exerted on the engaging element with both the front and rear hooks in engagement with the loops, at least the stems are scarcely subject to bend due to the peeling force while the individual hooks are angularly moved about their bases in a horizontal plane independently without interfering with each other and, at the same time, the upper portion of the hook resiliently deforms in the rising direction. Therefore the loops can be easily disengaged from the hooks without giving any damage to each other.

When an upward pulling force is exerted on the looped member in hanging engagement with the engaging element, a horizontal component force in right or left direction (i.e. up-and-down direction in FIG. 3) acts simultaneously on both the stems of the engaging element and the bases of the front and rear hooks while another component force in an opposite direction acts on the upper portions of the hooks. At the same time, an upward pulling force is exerted on the hooks.

At that time, since the thickness of the stems is great, the stems hardly bend as the component forces in opposite directions cancel each other when the peeling force is exerted on the engaging element. Meanwhile, the front and rear hooks deform so as to angularly move about their bases in a horizontal plane independently without interfering with each other and, at the same time, the upper portions of the hooks resiliently deform in the rising direction due to the pulling force. Therefore the loops are disengaged from the front and rear hooks without any damage.

Further, in the case that the front and rear hooks have difference in height from each other, in addition to the above-described function, since the individual hooks come into engagement with the loops which extend from various directions, in various postures, it is possible to increase the rate of engagement with the loops much higher as compared to the hooks having a common height, thus increasing the engaging strength.

DETAILED DESCRIPTION OF THE PREFERRED EMBODIMENTS

Typical embodiments of this invention will now be described in detail with reference to the accompanying drawings.

Figure 1:
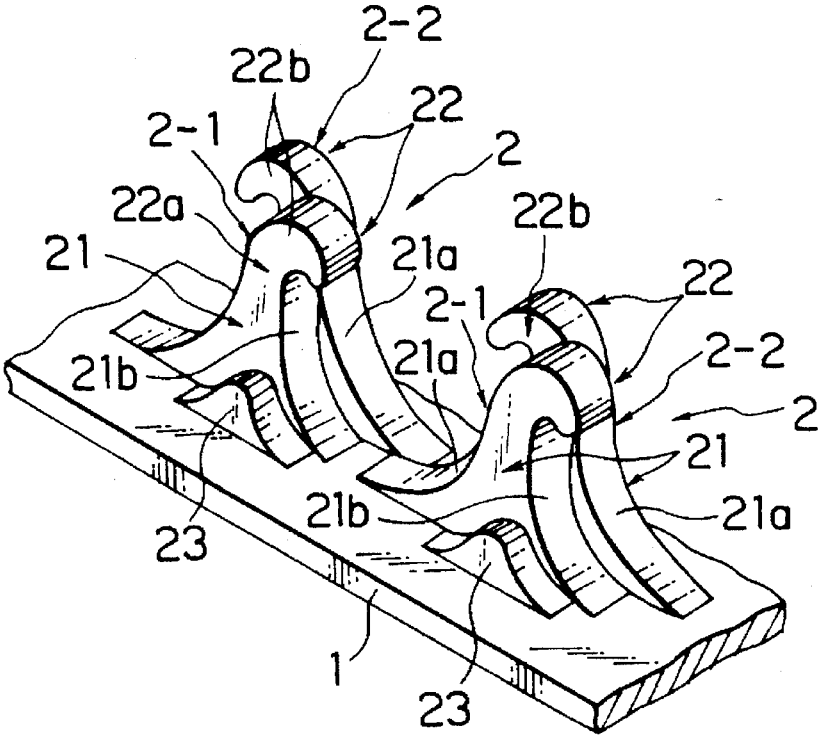
FIG. 1 is a fragmentary perspective view of a molded surface fastener according to a typical embodiment of this invention.

FIG. 1 is a fragmentary perspective view of a molded surface fastener according to a first embodiment of the invention. According to the first embodiment, a multiplicity of engaging elements 2 integrally molded on and projecting from an upper surface of a substrate sheet 1 are formed with pairs of engaging members as disclosed in, for example, U.S. Pat. No. 4,984,339 and European Pat. No. 064753A1. And in each of the engaging element 2, the pair of engaging members are arranged next to each other with their hooks directed in opposite directions, resembling a form in which the engaging members are integrally joined together at their side surfaces.

In the embodiment of FIG. 1, the engaging element 2 is composed of a pair of members 2-1, 2-2. Each member 2-1, 2-2 comprises a stem 21 having a rear surface 21*a* rising along a gentle curve from the upper surface of the substrate sheet 1 and a front surface 21*b* rising initially in a predetermined curvature and then perpendicularly from the upper surface of the substrate sheet 1, and a hook 22 extending from the rear surface 21*a* and the front surface 21*b* of the stem 21 in a predetermined curvature and terminating in a downwardly directed end. The two engaging members 2-1, 2-2 are arranged in close contact with their hooks 22, 22 directed in opposite directions and are integrally joined partly at their respective hooks 22, 22 and at their respective stems 21, 21, as indicated by diagonal dotted lines in FIG. 2. In the illustrated example, each stem 21 has on its lower outside surface a reinforcing rib 23. A multiplicity of such engaging elements 2 are formed on the upper surface of the substrate sheet 1 with the front and rear hooks 22, 22 of the individual engaging elements 2 arranged in straight rows.

Figure 2:
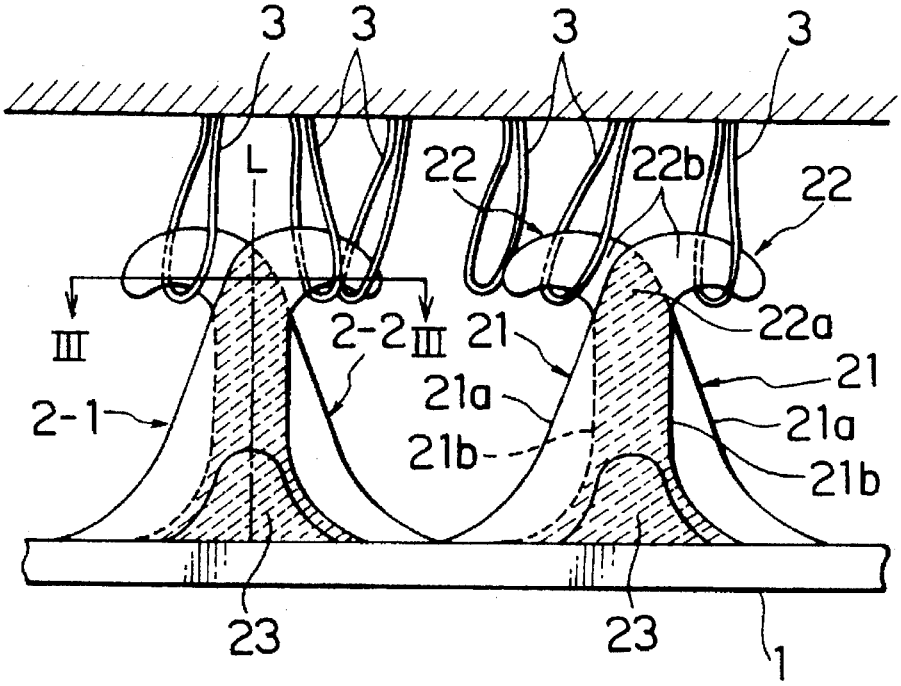
FIG. 2 is a fragmentary side view of the surface fastener, showing the manner in which engaging elements of the embodiment come into engagement with companion loops.
Figure 3:
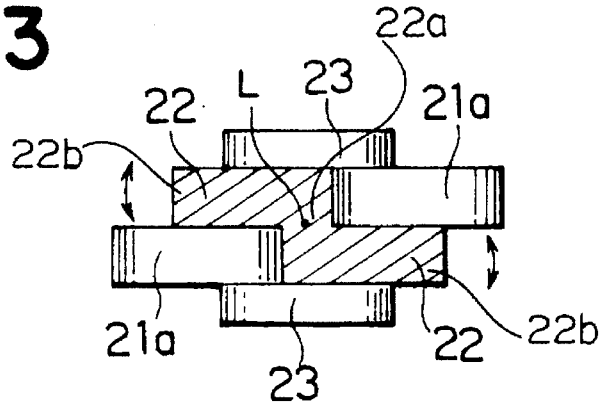
FIG. 3 is a cross-sectional view taken along line III—III of FIG. 2, showing the action of the engaging elements during peeling when two loops are in engagement respectively with front and rear books of the engaging element.

FIG. 2 shows a normal manner in which companion loops 3 are in engagement with the engaging elements 2 formed on the substrate sheet 1. FIG. 3 is a cross-sectional view taken along line III—III of FIG. 2, showing the action of the engaging element 2, when an upward peeling force is exerted on the surface fastener, in the case that two loops 3, 3 are in engagement with the front and rear hooks 22, 22 respectively. In this case, the front and rear hooks 22, 22 tend to engage the loops 3 not right above the respective hooks, but the front and/or rear hooks 22, 22 tend to engage the loops 3 off the positions right above the respective hooks.

In the conventional engaging element disclosed in the above-mentioned publications, assuming that its engaging force is equal to that of the engaging element of this invention, the stem of the conventional engaging element has a thickness about a half of the total thickness of the pair of stems 21, 21 of this invention and therefore tends to receive a great influence of the peeling force. For example, if two loops act on the engaging element in a common direction, the stem tends to bend together with the hooks so that the loops can hardly disengage from the hooks.

According to the engaging element structure of this invention, partly since the pair of stems 21, 21 has a great thickness in total and partly since the front and rear hooks 22, 22 are integrally joined at their bases 22*a*, 22*a*, the stem 21 and the base 22*a* of the hook 22 do not tend to bend due to an upward peeling force when the two loops 3, 3 are in engagement with the front and rear hooks 22, 22, respectively. In the meantime, the front and rear hooks 22, 22 deform so as to angularly move about their bases 22*a* in a horizontal plane independently without interfering with each other, and the upper portions 22*b*, 22*b* of the respective hooks 22, 22 deform in the rising direction. As a result, the loops 3, 3 tend to be disengaged from the hooks 22, 22 without any damage.

Figure 4:
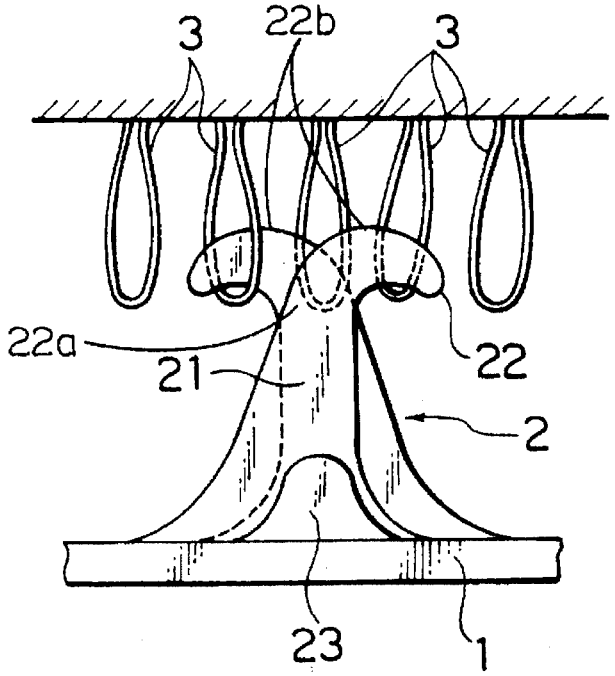
FIG. 4 is a fragmentary side view of the surface fastener, showing the manner in which a single loop is in engagement with only one of the front and rear hooks of the engaging element.
Figure 5:
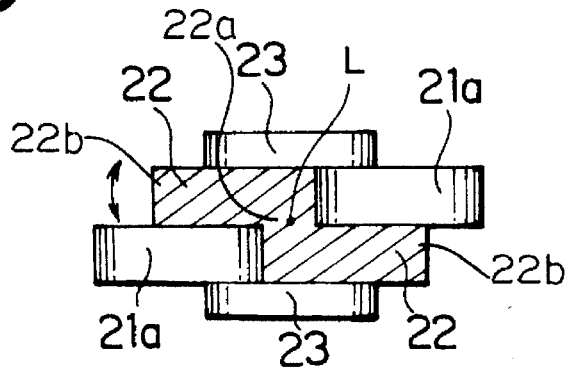
FIG. 5 is a cross-sectional view similar to FIG. 3, showing the action of the engaging element in the posture of FIG. 4 during peeling.

FIG. 4 shows the manner in which a single loop 3 is in engagement with one of the front and rear hooks 22 of the engaging element 2. FIG. 5 is a diagrammatic cross-sectional view similar to FIG. 3, but showing the action of engaging element 2 when the upward peeling force is exerted on the loop 3 in engagement with one of the front and rear books 22. In FIGS. 4 and 5, assuming that an upward peeling force is exerted on a single loop 3 in engagement with one of the front and rear hooks 22 of the engaging element 2, and that the hook 22 of the engaging element 2 is substantially identical with that of the conventional engaging element disclosed in the above-mentioned prior art publications, the stem 21 and the base 22*a* hardly bend in such a direction that the hook 22 rises due to the peeling force, partly since the pair of stems 21, 21 of the engaging element 2 of this invention has in total a width about double of the stem of the conventional engaging element and partly since the front and rear hooks 22, 22 have a common part at their bases 22*a*. Accordingly only the upper portion 22*b* of one book 22 in engagement with the loop 3 resiliently deforms without difficulty so that the loop 3 can be disengaged from the hook 22 without any damage to the upper portion 22*b* of the hook 22.

Figure 6:
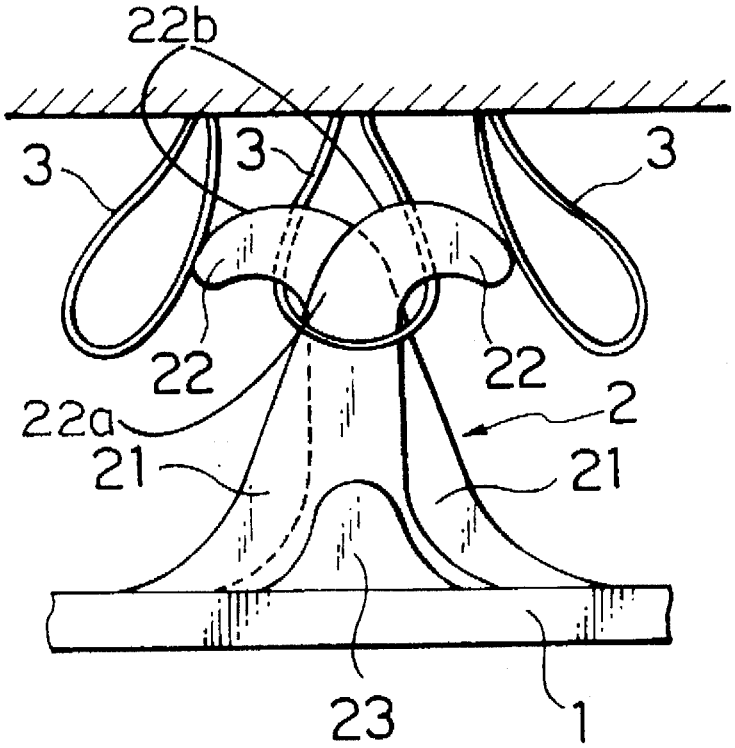
FIG. 6 is a fragmentary side view of the surface fastener, showing the manner in which a single loop is in engagement with the front and rear hooks of the engaging element at the same time.
Figure 7:
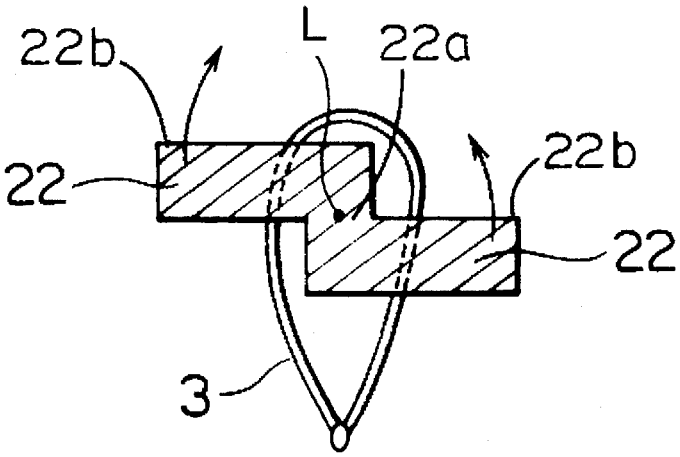
FIG. 7 is a cross-sectional view similar to FIGS. 3 and 5, showing the action of the engaging element in the posture of FIG. 6 during peeling.

FIG. 6 shows the engaging element 2 in hanging engagement with the loop 3. FIG. 7 is a diagrammatic cross-sectional view similar to FIG. 3, but showing a part of action of the engaging element 2 when the peeling force is exerted on the hoop 3 in hanging engagement with the engaging element 2. Assuming that an upward raising force is exerted on the loop 3 in hanging engagement with the engaging element 2, the stems 21, 21 of the engaging element 2 and the bases 22*a* of the front and rear books 22 are subject to a horizontal force in one direction while the upper portions 22*b* of the hooks 22 are subject to a force reverse to the first-named horizontal force and double in strength. At the same time, an upward pulling force is exerted on the hooks 22.

Partly since the stems 21, 21 have a large thickness in total and partly since the bases 22*a*, 22*a* of the front and rear hooks 22, 22 are integral with each other, when the peeling force as described above exerts on the engaging elements 2, a force reverse to the first-named horizontal force and double in strength (because the loop B engages the engaging element 2 at two positions) is exerted on the stems 21, 21 and the bases 22*a*, 22*a* of the hooks 22, 22 to cancel the first-named horizontal force so that the stems 21, 21 and the bases 22*a*, 22*a* hardly bend. Meanwhile, the front and rear hooks 22, 22 deform so as to angularly move about their respective bases 22*a*, 22*a* in a horizontal plane independently without interfering with each other, and the upper portions 22*b*, 22*b* of the hooks 22, 22 resiliently deform in a rising direction due to the pulling force. As a result, the loop 3 can be disengaged from the individual hooks 22, 22 easily without damaging each other.

Figure 8:
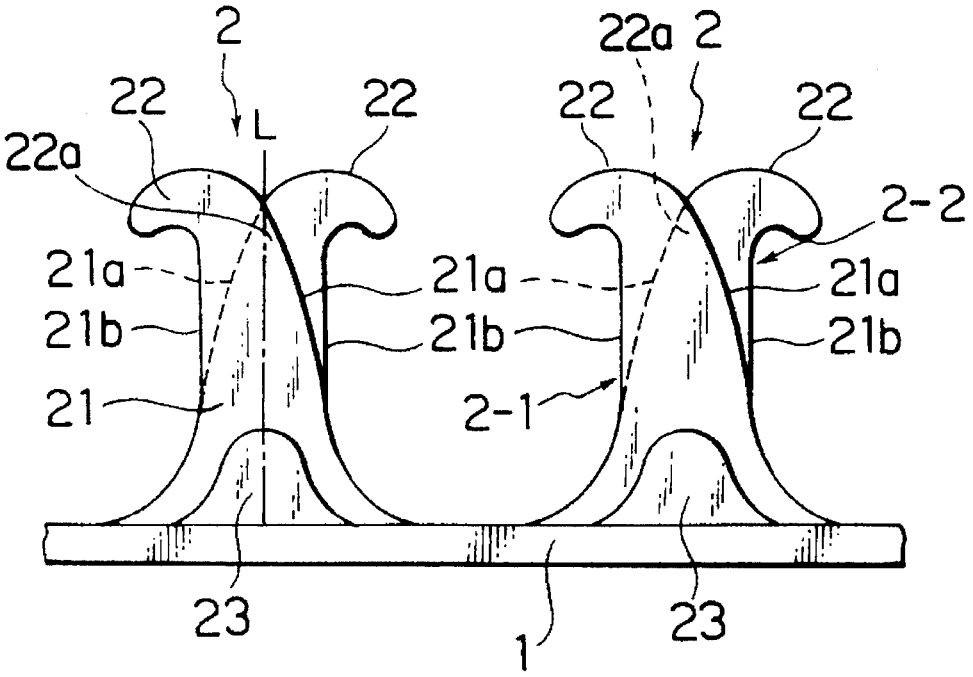
FIG. 8 is a fragmentary side view of a molded surface fastener according to a modified form of the embodiment.

FIG. 8 shows a modified form of the first embodiment. In the modified form, the stems 21, 21 have a unitary structure, and the front and rear hooks 22, 22 are integrally joined together at their bases 22*a*. This modified form has a function identical with the foregoing embodiment and secures a desired engaging force so that the engaging element 2 can be smoothly disengaged from the companion loops 3.

Figure 9:
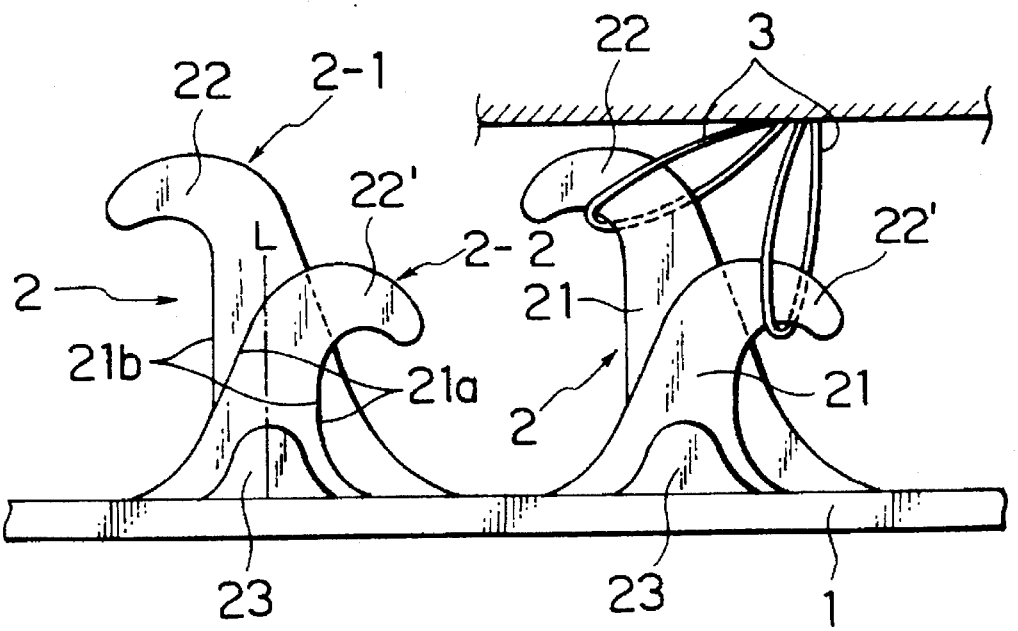
FIG. 9 is a fragmentary perspective view of a molded surface fastener according to another typical embodiment of the invention.

FIG. 9 is a fragmentary perspective view of a molded surface fastener according to another typical embodiment of this invention. The engaging element 2 of this embodiment is differentiated over the foregoing embodiment in that two members 2-1, 2-2 of the engaging element 2 have different heights. With this arrangement, since the individual hooks 22, 22' different in height come into engagement with the loops 3, 3 which extend from various directions, in various postures as shown in FIG. 9, it is possible to increase the rate of engagement with the loops 3 much higher as compared to the hooks 22, 22 halving a common height, thus increasing the engaging strength. The heights of the engaging members 2-1, 2-2 may be determined as desired; for example, the higher and lower engaging members 2-1, 2-2 may have a height of 4 mm and a height of 2–3 mm respectively.

Figure 10:
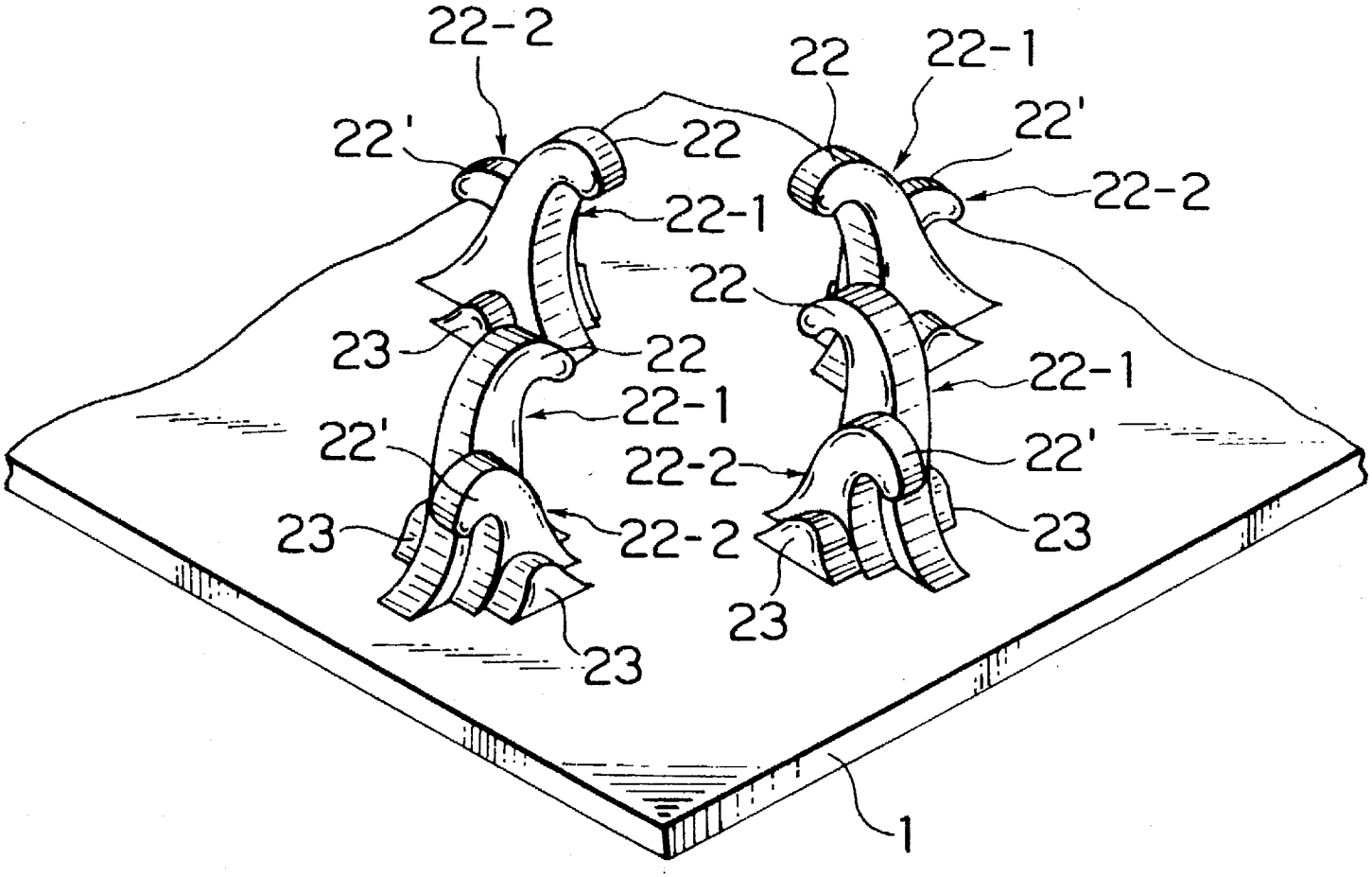
FIG. 10 is a fragmentary perspective view of the molded surface fastener of FIG. 9, showing an example of arrangement of engaging elements.
Figure 11:
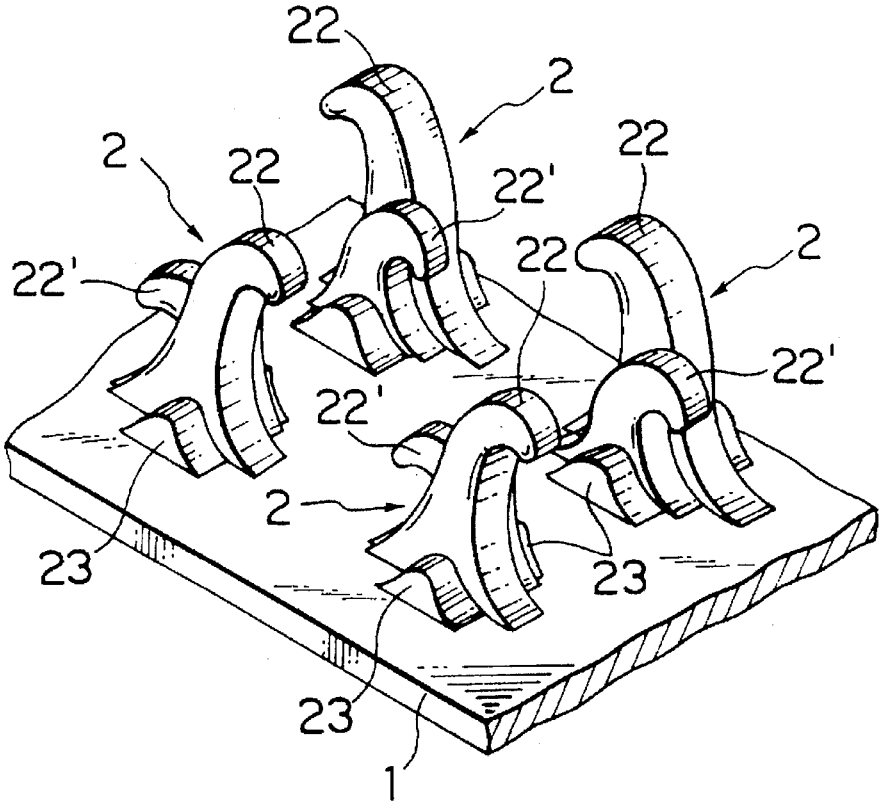
FIG. 11 is a fragmentary perspective view similar to FIG. 10, showing another example of arrangement of the engaging elements.
Figure 12:
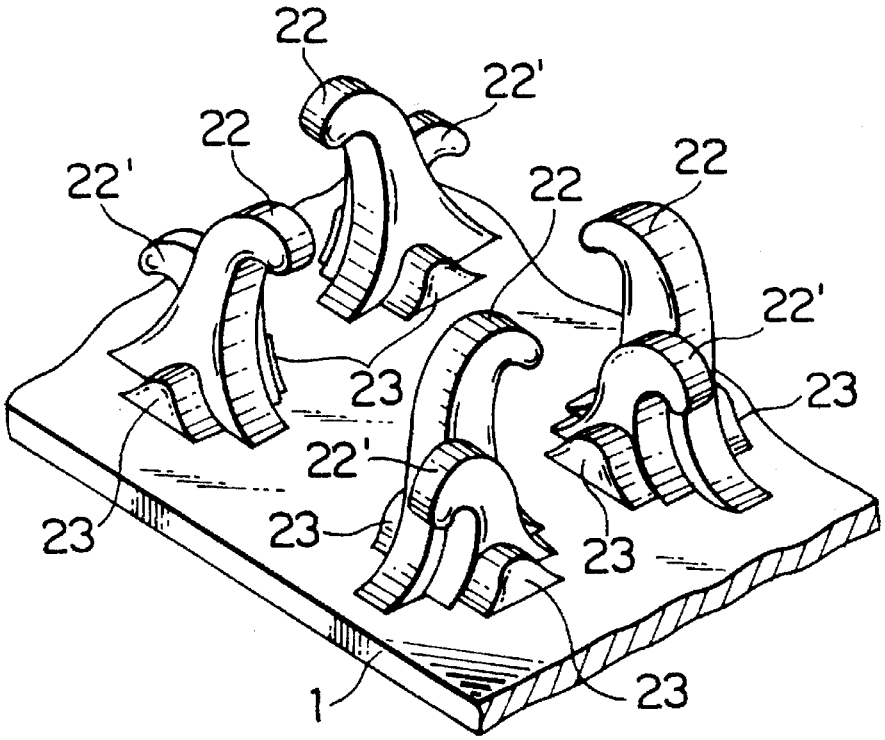
FIG. 12 is a fragmentary perspective view similar to FIGS. 10 and 11, showing still another example of arrangement of the engaging elements.

As is apparent from the foregoing description, this invention may be used in to various forms. For example, though not shown in the drawings, the front and rear hooks 22, 22 of the engaging elements 2-1, 2-2 arranged parallel and next to each other may be perfectly independent of each other including the bases 22*a*, 22*a*. Alternatively, the stems 21, 21 are integrally joined only at their contact portions, with which the above-mentioned functions can be expected. The arrangement of the engaging elements 2 of this invention should by no means be limited to the illustrated example, and various other arrangements may be suggested. FIGS. 10 through 12 show examples of arrangement of the engaging elements 2. Each of the engaging elements 2 of the illustrated examples has the form shown in FIG. 9. According to the arrangement example of FIG. 10, in four adjacent engaging elements 2, the hooks 22, 22 of the higher engaging members 2-1, 2-1 of the confronting pair of adjacent engaging elements 2, 2 are directed toward each other, while the hooks 22', 22' of the lower engaging members 2-2, 2-2 of the confronting pair of adjacent engaging elements 2, 2 are directed away from each other. According to the arrangement of FIG. 11, the hooks 22 of the engaging elements 2 in adjacent rows are directed opposite to each other. According to the arrangement example of FIG. 12, the hooks 22, 22' of each pair of adjacent engaging elements 2 are arranged perpendicularly to one another. By changing the directions of the hooks 22 in various ways, it is possible to allow the engaging elements 2 to come into engagement with the loops 3 in various directions, thus eliminating any orientation in engaging force.

As is apparent from the foregoing description, according to the molded surface fastener of this invention, partly since each engaging element 2 has a pair of hooks 22 extending in opposite directions from the upper end of the stem 21 standing from the Upper surface of the substrate sheet 1, and partly since the front and rear hooks 22, 22 are formed next to each other and independently one on each side of the center line L of the pair of stems 21, 21, both the rate of engagement and the engaging strength are increased as compared to the conventional single-hook engaging element, and so the book 22 deforms upwardly moving in a horizontal plane about the center line of the pair of stems 21, 21, with no undue force on the hooks 22, 22 and loops 3 and hence no damage thereto, to be disengaged from the loops 3 smoothly during the peeling. Thus this engaging element 2 has a good durability. The molded surface fastener of this invention has therefore adequate engaging strength and is hence particularly useful when used in joining industrial materials, such as wall and ceiling materials, in which it is required not to cause any damage to the engaging elements.

What is claimed is:

1. A molded surface fastener comprising:

(a) a substrate sheet; and (b) a multiplicity of engaging elements molded in rows on one surface of said substrate sheet, (c) each of said engaging elements having a pair of stems standing from said one surface of said substrate sheet, molded integrally from said substrate sheet upwardly along at least a portion of a height of said stems, and a pair of hooks extending in opposite directions from distal ends of said stems, said pair of hooks being formed in a pair of parallel planes perpendicular to the general plane of said substrate sheet on opposite sides of the central line of said pair of stems.

2. A molded surface fastener comprising:

(a) a substrate sheet; and (b) a multiplicity of engaging elements molded in rows on one surface of said substrate sheet;

(c) each of said engaging elements having a pair of stems standing from said one surface of said substrate sheet, and a pair of hooks extending in opposite directions from distal ends of said stems, said pair of hooks being formed in a pair of parallel planes perpendicular to the general plane of said substrate sheet on opposite sides of the central line of said pair of stems;

wherein in each said engaging element, a part of said pair of hooks and also most part of said pair of stems are integral with each other.

3. A molded surface fastener comprising:

(a) a substrate sheet; and (b) a multiplicity of engaging elements molded in rows on one surface of said substrate sheet;

(c) each of said engaging elements having a pair of stems standing from said one surface of said substrate sheet, and a pair of hooks extending in opposite directions from distal ends of said stems, said pair of hooks being formed in a pair of parallel planes perpendicular to the general plane of said substrate sheet on opposite sides of the central line of said pair of stems;

wherein each of said engaging element is composed of first and second hooked members each having said stem and said hook, and said first and second hooked members are integrally joined together at least part of confronting side surfaces of said stems.

4. A molded surface fastener according to claim 1, wherein said hooks are identical in height with each other.

5. A molded surface fastener according to claim 1, wherein said hooks are different in height from each other.

6. A molded surface fastener comprising:

a substrate sheet;

a multiplicity of engaging elements molded in rows on one surface of said substrate sheet;

each of said engaging elements having a pair of stems standing from said one surface of said substrate sheet, molded together integrally from said substrate sheet upwardly along at least a portion of a height of said stems, and a pair of hooks extending in opposite directions, each hook of said pair of hooks extending from a distal end of one stem of said pair of stems, said stems integrally molded together in a central plane located between said stems, said hooks being located on opposite sides of the central plane and extending in a direction parallel to said central plane.

7. A molded surface fastener according to claim 6, wherein said pair of stems are molded integrally from said substrate sheet upwardly along an entire height of said stems, and portions of said pair of hooks are also molded integrally together.

8. A molded surface fastener according to claim 6, wherein said hooks of said pair of hooks are identical in height with each other.

9. A molded surface fastener according to claim 6, wherein said hooks of said pair of hooks are different in height from each other.

* * * * *